US006032629A

United States Patent [19]

Uchida

[11] Patent Number: 6,032,629

[45] Date of Patent: Mar. 7, 2000

[54] VARIABLE VALVE TIMING ARRANGEMENT

[75] Inventor: Masahiro Uchida, Iwata, Japan

[73] Assignee: Yamaha Hatsudoki Kabushiki Kaisha, Iwata, Japan

[21] Appl. No.: 09/299,779

[22] Filed: Apr. 26, 1999

[30] Foreign Application Priority Data

Apr. 24, 1998 [JP] Japan ..... 10-114892

[51] Int. Cl.[7] ..... F01C 21/04; F01L 1/344

[52] U.S. Cl. ..... 123/90.34; 123/193.3; 123/196 M

[58] Field of Search ..... 123/90.15, 90.17, 123/90.31, 90.33, 90.34, 90.38, 196 R, 196 M, 193.5, 193.3

[56] References Cited

U.S. PATENT DOCUMENTS

| | | | |
|---|---|---|---|
| 5,012,773 | 5/1991 | Akasaka et al. | 123/90.17 |
| 5,144,921 | 9/1992 | Clos et al. | 123/90.17 |
| 5,150,675 | 9/1992 | Murata | 123/193.5 |
| 5,209,193 | 5/1993 | Uchida et al. | 123/90.17 |
| 5,301,639 | 4/1994 | Satou | 123/90.17 |
| 5,452,690 | 9/1995 | Kobayashi | 123/90.38 |
| 5,458,099 | 10/1995 | Koller et al. | 123/193.5 |
| 5,474,038 | 12/1995 | Golovatai-Schmidt et al. | 123/90.17 |
| 5,540,197 | 7/1996 | Golovatai-Schmidt et al. | 123/90.17 |
| 5,669,343 | 9/1997 | Adachi | 123/90.17 |
| 5,713,319 | 2/1998 | Tortul | 123/90.17 |
| 5,718,196 | 2/1998 | Uchiyama et al. | 123/195 C |
| 5,797,363 | 8/1998 | Nakamura | 123/90.17 |
| 5,803,031 | 9/1998 | Moriya | 123/90.17 |
| 5,954,019 | 9/1999 | Yoshikawa et al. | 123/90.17 |

*Primary Examiner*—Weilun Lo

*Attorney, Agent, or Firm*—Knobbe, Martens, Olson & Bear LLP

[57] ABSTRACT

Two embodiments of VVT mechanisms for internal combustion engines. The VVT mechanisms are hydraulically operated by the engine lubricating oil through control passages formed in the forward-most bearing portion of the camshaft. However, spaced on both sides of these control passages, there are provided lubricant supplies to the forwardmost and rearward most ends of the forward bearing surfaces of the camshaft so as to provide good lubrication, particularly in the more highly loaded forwardmost portion thereof.

3 Claims, 5 Drawing Sheets

VARIABLE VALVE TIMING ARRANGEMENT

BACKGROUND OF THE INVENTION

This invention relates to a variable valve timing arrangement for an engine and more particularly to an improved arrangement for operating and lubricating such variable valve timing arrangements.

In order to improve engine performance over a wider range of engine speeds and loads, it has been proposed to employ a variable valve timing mechanism (VVT) in the drive for the camshafts of the engine. By varying the phase angle of the camshaft relative to its driving element, it is possible to change the valve timing and, accordingly, make adjustments in valve timing during engine running. In this way, the optimum valve timing can be chosen for each engine running condition.

Conventionally, the variable valve timing mechanism is interposed in the drive between the crankshaft driven element and the camshaft, and generally includes a hydraulically-operated mechanism that is mounted on the end of the camshaft and varies the phase angle at this specific location.

In order to transmit actuating fluid to the variable valve timing mechanism, it has been proposed to provide passages in the bearing arrangement of the engine body for the camshaft which mate with grooves and drilled passageways in the camshaft. Normally, engine lubricant is employed for actuating the variable valve timing mechanism.

It is necessary to obtain close fits in the camshaft and engine body bearing surfaces where these oil supply and return passages are formed. However, it is also desirable or necessary to lubricate the bearing surfaces in this same area. Generally, with prior art constructions, the lubricant is delivered to the camshaft bearing surfaces at a point that is axially spaced away from the valved passages for the variable valve timing mechanism and, accordingly, the camshaft drive system. As a result, there is a cantilevered end of the camshaft which does not receive lubricant. This is obviously undesirable.

It is, therefore, a principle object of this invention to provide an improved variable valve timing mechanism wherein lubricant is supplied to the camshaft surfaces immediately adjacent the variable valve timing mechanism and where the load is the highest.

It is a further object of this invention to provide an improved hydraulic supply, control and lubricating arrangement for the VVT mechanism of an internal combustion engine.

SUMMARY OF THE INVENTION

This invention is adapted to be embodied in an internal combustion engine having an engine body journalling at least one camshaft for operating valves of the engine. A camshaft drive arrangement is provided at one end of the camshaft and this incorporates a variable valve timing mechanism for varying the phase angle between the crankshaft-driven element of the variable valve timing mechanism and the camshaft. The variable valve timing mechanism is hydraulically operated and is supplied with lubricant for its actuation through supply grooves formed in the end bearing surface of the camshaft adjacent the variable valve timing mechanism and drilled control passageways formed in this end of the camshaft. In accordance with the invention, a lubricant supply passage is provided that supplies lubricant to the camshaft bearing surface in the area between the supply grooves for the variable valve timing mechanism and the variable valve timing mechanism.

DETAILED DESCRIPTION OF THE PREFERRED EMBODIMENTS

Figure 1:
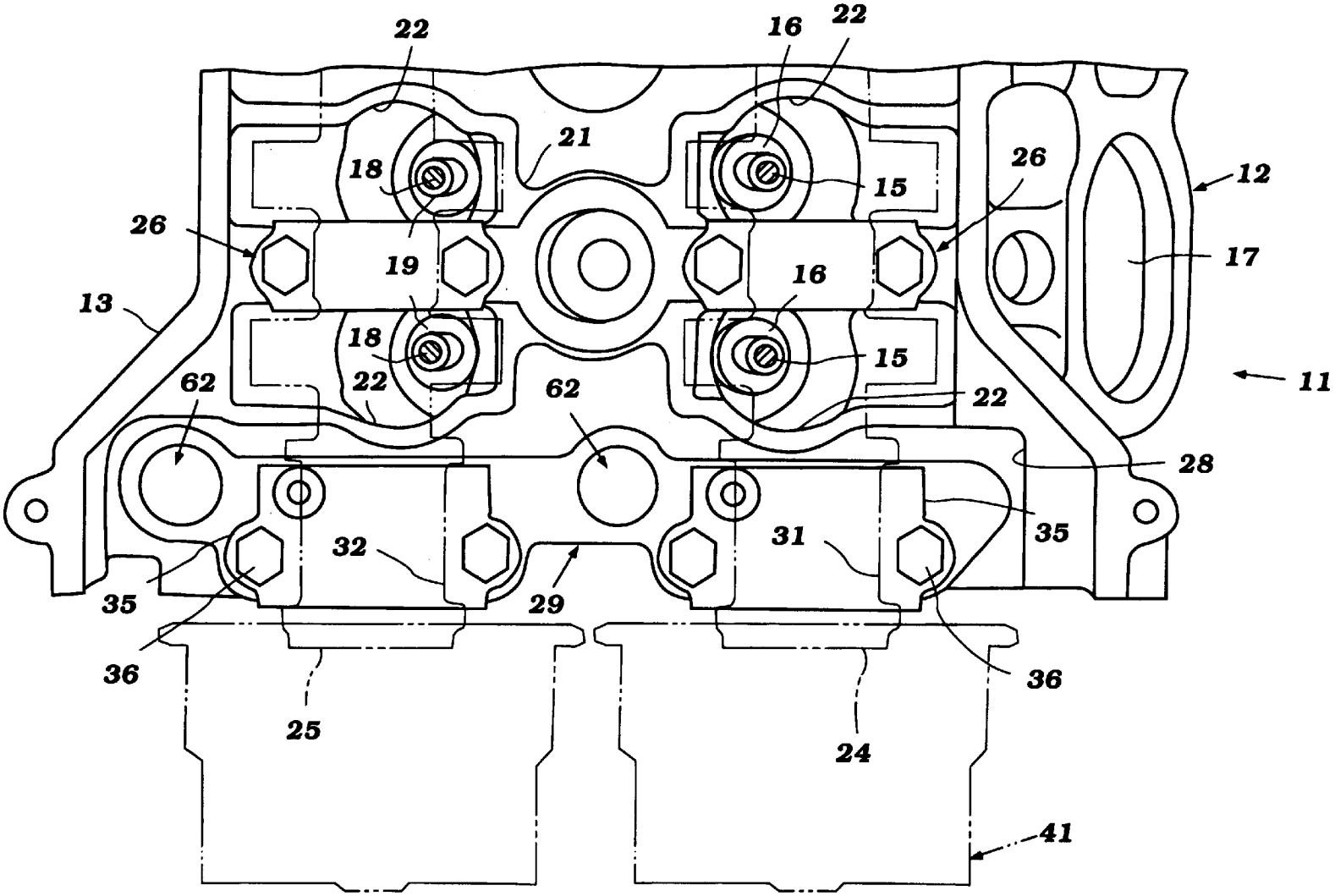
FIG. 1 is a top plan view of a cylinder head assembly of an engine embodying the invention with the cam cover and valve actuating elements removed and showing the camshaft and variable valve timing mechanism in phantom.

Referring now to the drawings and initially to the embodiment of FIGS. 1–4, an internal combustion engine constructed in accordance with this embodiment is shown partially and is identified generally by the reference numeral 11. The engine 11 is, in the illustrated embodiment, a multi-cylinder, twin overhead cam, internal combustion engine having an in-line configuration. Although an engine with twin overhead cams and of the in-line type as illustrated, it will be readily apparent to those skilled in the art how the invention can be utilized with engines having other cylinder numbers, other configurations and other numbers of camshafts. The invention, however, does have particular utility where it is desired to change the phase angle between the intake and exhaust valves, and this generally requires separate camshafts for such valves.

Since the engine is of the twin overhead cam type and the invention deals with the variable valve timing mechanism associated therewith, only the upper portion of the engine 11 is depicted and only part of the cylinder head assembly, indicated generally by the reference numeral 12, is illustrated and will be described. It is believed from the following description that those skilled in the art will readily understand how the invention can be practiced with any desired type of engine construction.

Figure 3:
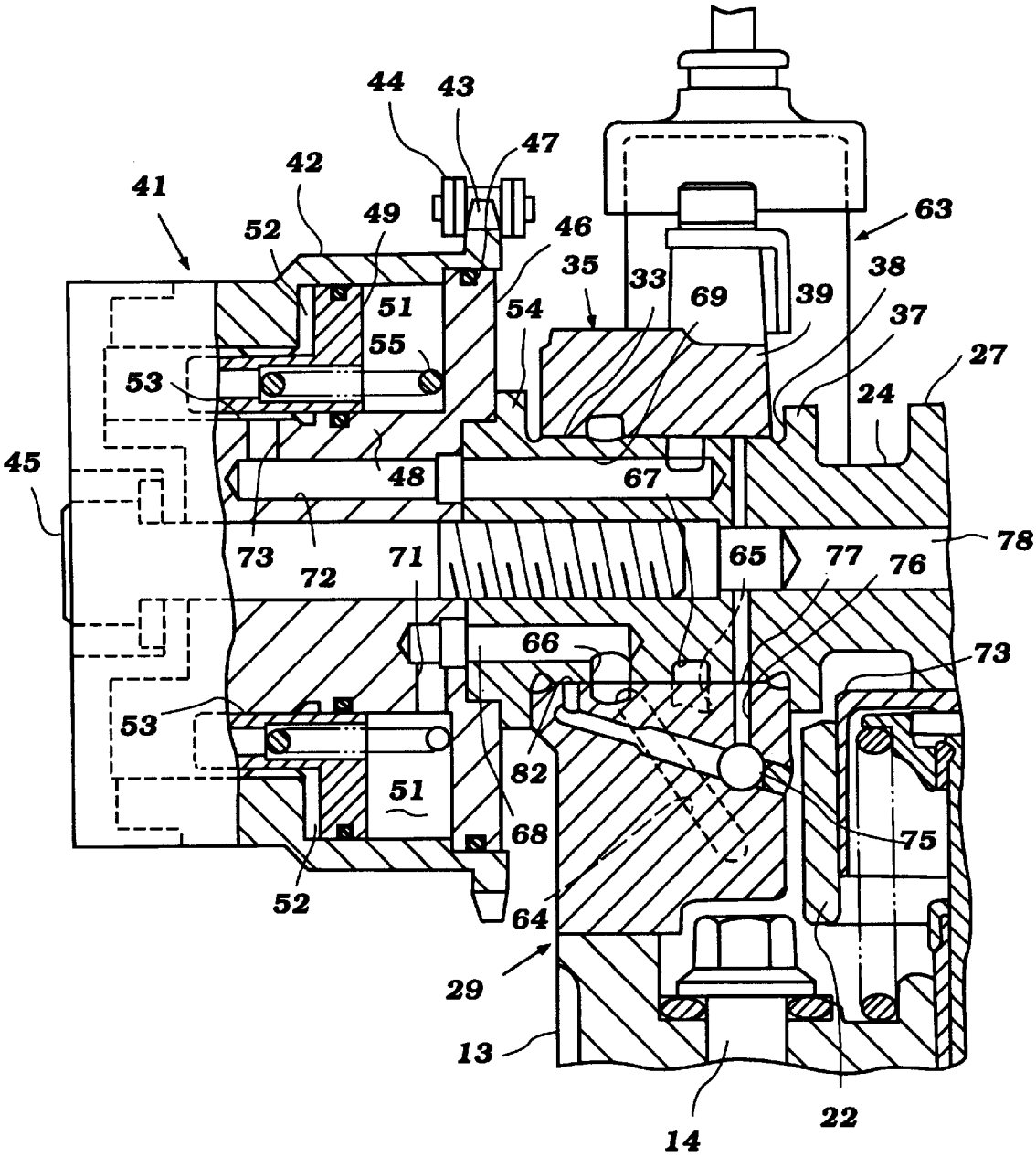
FIG. 3 is an enlarged cross-sectional view taken along the line 3—3 of FIG. 2 and shows the variable valve timing mechanism and bearing arrangement for the driven end of the camshaft.

The cylinder head assembly 12 includes a main cylinder head member 13 which is detachably connected to an associated cylinder block by fasteners, one of which appears in FIG. 3 and is identified by the reference numeral 14. The lower surface of the cylinder head member 13 may be formed with recesses that cooperate with the closed cylinder bores and the pistons therein to form the combustion chambers of the engine.

In the illustrated embodiment, the engine 11 is of the four valve per cylinder type and hence has two intake valves 15 (FIG. 1) that are supported within guides 16 in the main cylinder head member 13 and which control the flow through intake valve seats formed at the termination of an intake passage 17.

Also, a pair of exhaust valves 18 are mounted on the opposite side of the cylinder head member 13 in respective valve guides 19. These exhaust valves 18 control the flow through exhaust passages which do not appear in the drawings, but which can have any known type of configuration.

The main cylinder head member 13 is formed with bridging sections 21 that extend across the cylinder bores and which define tappet receiving openings 22 in which thimble tappets are slidably supported for operating the valves 15 and 18. One of these tappets appears partially in FIG. 3 and is identified generally by the reference numeral 23.

These tappets 23 are operated either by an intake camshaft 24 or an exhaust camshaft 25, depending upon whether they are intake valves 15 or the exhaust valves 18. The camshafts 24 and 25 are journaled in the bridging sections 21 by means of bearing caps 26 that are affixed to the cylinder head member 13 in a known manner. These camshafts 24 and 25 have lobes, which appear only in FIGS. 3 and 4 where they are identified by the reference numeral 27.

At the front of the engine, or more specifically of the cylinder head assembly 12, the cylinder head member 13 is formed with a recess 28 in which a combined valve carrying and bearing member, indicated generally by the reference numeral 29, is affixed. It will be seen that the member 29 is provided with a recess in its lower surface so as to clear the forward-most cylinder head fasteners 14, as best seen in FIG. 3.

This member 29 forms bearing surfaces 31 and 32 that receive end bearing surfaces 33 and 34 of the intake and exhaust camshafts 24 and 25, respectively. Bearing caps, indicated by the reference numerals 35, are affixed to the bearing member 29 by threaded fasteners 36 so as to complete the journalling of the camshafts 24 and 25 in the cylinder head assembly.

Adjacent the bearing caps 35, both the intake camshaft 24 and the exhaust camshaft 25 are provided with projecting sections 37 that have thrust surfaces 38 that are engaged with the back sides of the bearing caps 35 and specifically portions 39 thereof to provide axial location of the camshafts 24 and 25 in the cylinder head assembly 12.

Figure 2:
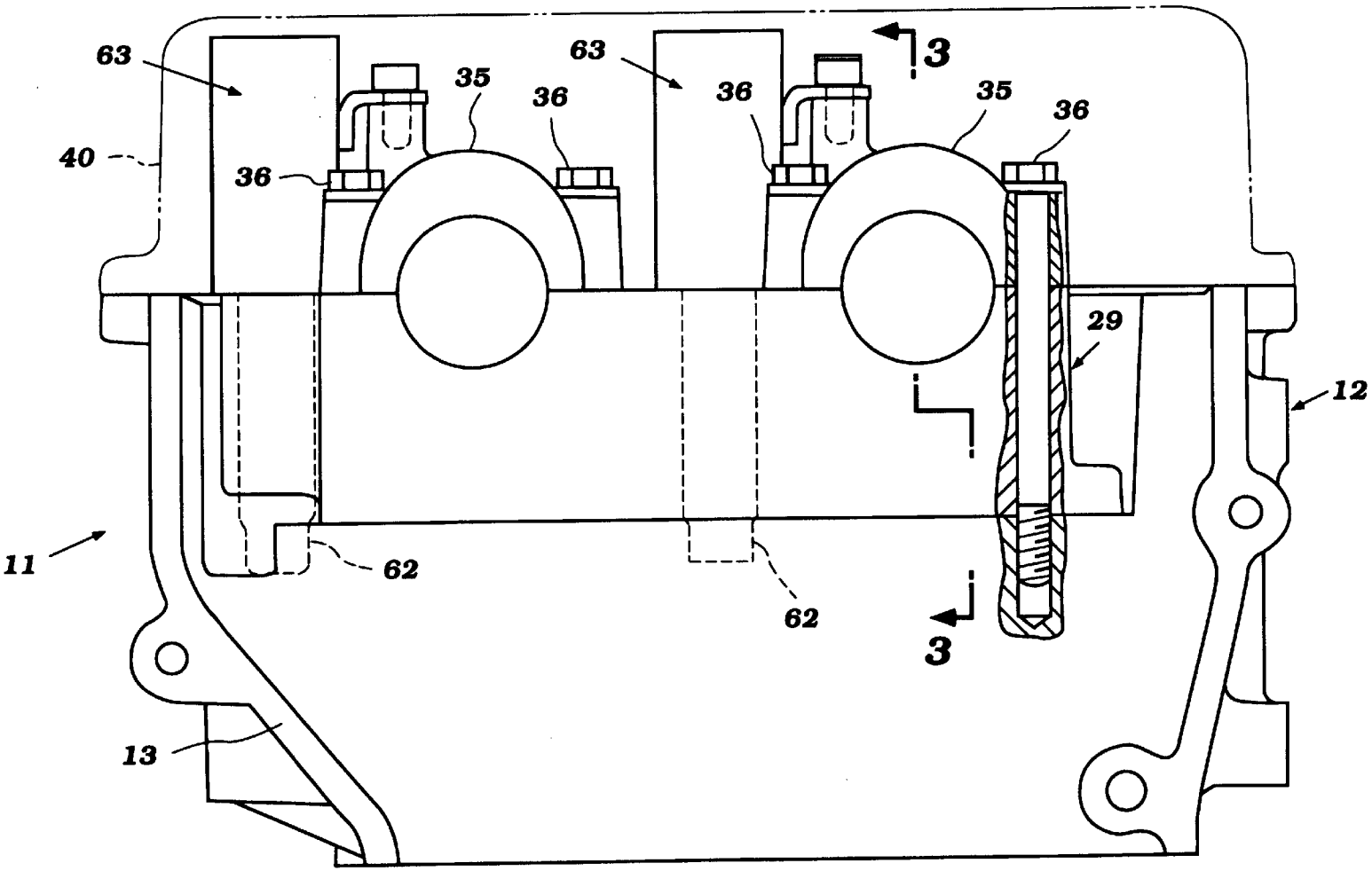
FIG. 2 is a front elevational view of the portion of the engine shown in FIG. 1 that shows the elements missing from FIG. 1 and with a portion broken away and shown in phantom.

The fasteners 36, in addition to securing the bearing caps 35 to the carrier member 29 also affixed the carrier member 29 to the cylinder head member 13, as best seen in the right hand side of FIG. 2. The upper end of the main cylinder head member 13 forms a cam chamber in which the camshafts 24 and 25 are contained. This cam chamber is closed by a cam cover 40.

The camshafts 24 and 25 are driven at one-half crankshaft speed by means of a suitable timing mechanism that includes a pair of VVT mechanisms, each of which is indicated generally by the reference numeral 41, and which have basically the same construction.

These VVT mechanisms 41 include an outer housing member 42 that has formed on the side adjacent the cylinder head member 13 integral sprocket teeth 43. These teeth 43 are engaged by a timing chain 44 so as to establish a timing drive between the crankshaft (not shown) and the VVT mechanisms 41 so that the outer members 42 thereof will be driven at one-half crankshaft speed.

The outer housing member 42 of the VVT mechanisms 41 has a generally cup shape that is closed at one end by either an integral or separately attached end member. A threaded fastener 45 axially fix this outer member 42 to the respective camshafts 24 and 25.

The other end of the outer housing member 41 is closed by a removable end closure 46 that carries an o-ring seal 47 so as to define a cylindrical cavity around a hub portion 48 of the end member 46. An annular piston 49 is mounted in this cavity and defines a pair of fluid chambers S1 and S2.

The piston 49 has a splined connection to the outer member 49 that permits it to move axially while holding it against rotation. In addition, the inner surface of the piston 49 has a splined connection that is engaged with a splined portion 48 of the end member 46. The connection between the end member 46 and a forward-most flange 54 of the camshafts 24 and 25 connects these two elements so that they will rotate together.

Hence, when the piston 49 is moved axially, the inner member 48 and its joined camshaft 24 or 25 will rotate relative to the outer member 42 so as to change the phase angle between the associated camshaft 24 or 25 and the crankshaft. The type of VVT mechanism described is well known in the art, and, for that reason, further description of it is not believed to be necessary to permit those skilled in the art to practice the invention.

A coil compression spring 55 is mounted within the chamber S1 and urges the piston 49 to the left to increase the volume of the chamber S1 and decrease the volume of the chamber S2. By controlling the pressures in the chambers S1 and S2, the axial position of the piston 49 can be changed and the valve timing also is thus changed. The actuating mechanism for achieving this operation will now be described by primary reference to FIGS. 2 and 4.

The variable valve timing mechanisms 41 are operated by the same lubricating oil that is employed for lubricating the engine, as is typical in this art. The lubricating system for the engine includes a main oil pump which is shown schematically in FIG. 4 and which is identified by the reference numeral 56. The oil pump 56 delivers oil to a cylinder block gallery 57 that has branches that extend upwardly through the cylinder block and which mate with passages 58 formed in the cylinder head member 13.

These passages 58 have counter bores that receive small, readily replaceable oil filter elements 59. The oil filter elements 59 lie below the bearing member 29 and deliver the lubricant under pressure to a pair of supply passages 61 formed therein, one for each of the camshafts 24 and 25.

These supply passages 61 extend to spool valves 62 of respective control valve assemblies 63. These control valve assemblies 63 are comprised of solenoid motors that actuate the valve spool 61 so as to control the pressure in the chambers S1 and S2. The solenoid motors are controlled by an ECU (not shown) in accordance with any desired control strategy.

Each spool valve 62 has a portion that defines a pair of lands. These lands control the communication of fluid from the passages 61 to either of first and second passages 64 and 65 which are formed in the bearing member 29 and which terminate at axially spaced locations along the bearing surface portion 31 or 32 thereof in circumferential control grooves 66 and 67. These control grooves 66 and 67 communicate with the ends of control passages 68 and 69 formed in the ends of the intake and exhaust camshafts 24 and 25, respectively. The passages 68 communicates with a drilling 71 formed in the VVT inner member 48 that communicates at its other end with the chamber S1.

The passage 69 communicates with a corresponding elongated passage 72 formed in the inner member 48 and which terminates in a drilled passageway 73 that communicates with the chamber S2. The valve elements 62 also cooperate with return passages, two of which appear in the drawings in FIG. 4, and are identified by the reference numeral 74.

Thus, by controlling the pressurization of the chambers S1 and S2, as has already been noted, the axial position of the pistons 49 and accordingly the phase angle of the camshafts 24 and 25 can be adjusted. The description as preceding may be considered to be typical of any prior art-type construction with which the invention can be employed.

The main pressure line 61 in the bearing member 29 also intersect a lubricating passageway 75 that is formed in the member 29 adjacent one end of the camshafts 24 and 25 and specifically close to the thrust surfaces 38 thereof. These passages 75 are intersected by passages 76 which, in turn, mate with grooves and radially-drilled passages 77 formed in the camshafts 24 and 25 and specifically the rearward-most bearing portions 33 thereof. Hence, these areas will be lubricated.

Figure 4:
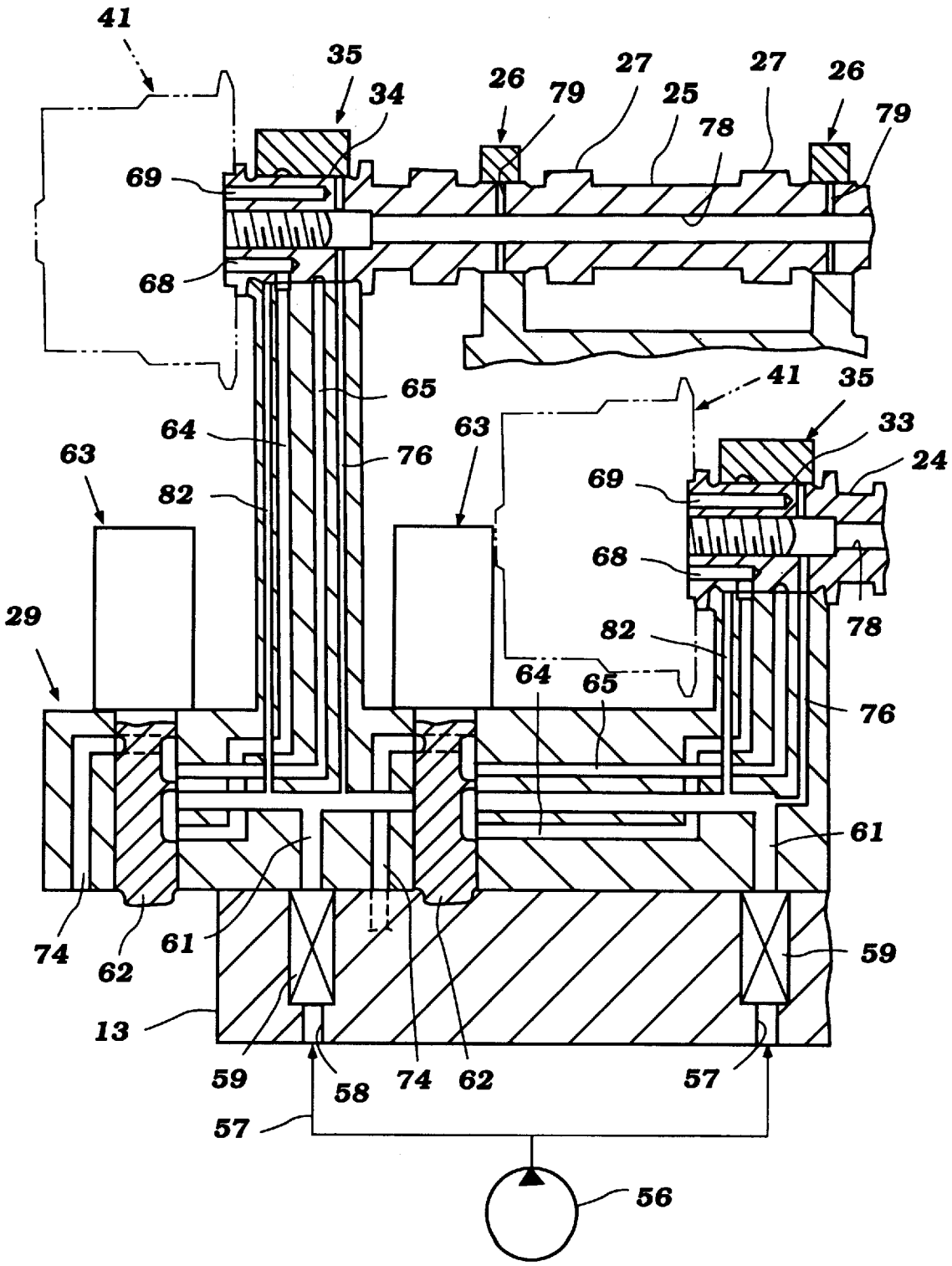
FIG. 4 is a partially schematic view of the variable valve timing mechanism showing the relationship of the passages for lubrication and for actuating the variable valve timing mechanism.

Furthermore, the passages 77 intersect a longitudinally-extending passageway 78 that is drilled in each camshaft 24 and 25 so as to deliver lubricant along the axial length thereof to the bearing areas journaled by the bearing caps 26, as best seen in FIG. 4 wherein the lubricating passages for these areas are indicated at 79.

The construction of the lubricating system as thus far described is also the same as that utilized in the prior art. However, this means that the forward portion of the bearing surfaces 33 and 34 of the camshafts 24 and 25 receive substantially no lubricant. Also, these are the areas of highest wear due to the proximity to the sprocket 73. Thus, in accordance with the invention and specifically in this embodiment, the bearing member 29 is formed with further drilled passages 81 that intersect the main supply passages 75 and pass forwardly clear of the lines 64 and 65 to mate with further supply passages 82 formed at the front of the camshaft bearing member 29 and in registry with the bearing surface 33 thereof adjacent the flange 54 and at the forward end of the bearing caps 35. Hence, there will be good lubrication of the entire front bearing surface of the respective camshafts 24 and 25 and wear is substantially reduced from the prior art type of construction.

Figure 5:
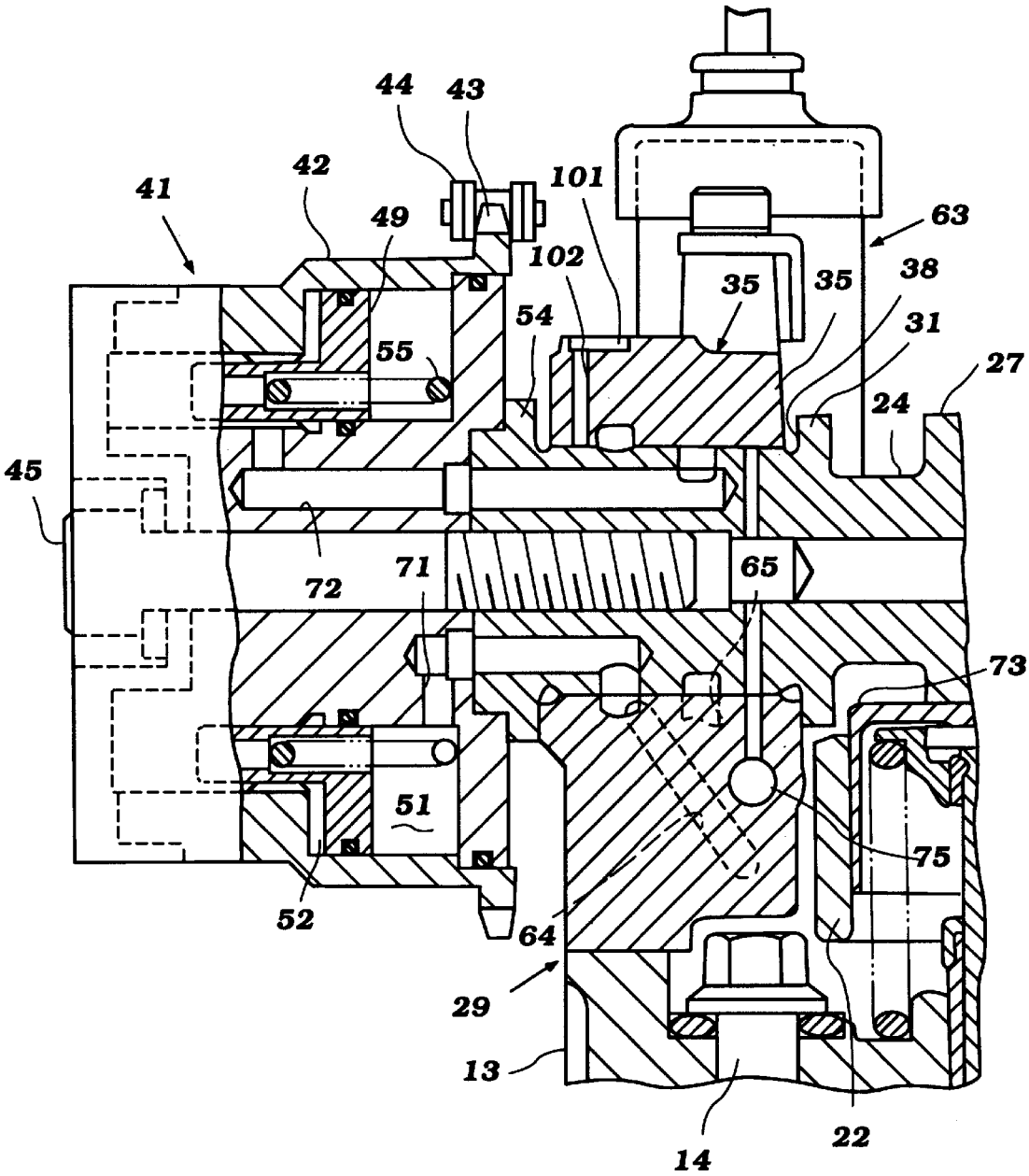
FIG. 5 is a cross-sectional view, in part similar to FIG. 3, and shows a second embodiment of the invention.

FIG. 5 shows another embodiment of the invention which also lubricates the portion of the camshaft bearing surfaces 33 and 34 forwardly of the control grooves for the VVT mechanism. With this embodiment, however, the lubricating structure is simpler and hence only a single figure, corresponding to FIG. 3 of the previous embodiment, is necessary to permit those skilled in the art to practice the invention.

As seen in this figure, the main delivery passage 75 is not intersected by another passage. Rather, each bearing cap 35 is provided with a collecting pool recess 101 formed in the upper end thereof that will collect and capture oil that is always present in the cam chamber. This pool 101 feeds a vertically extending, gravity feed passage 102 that extends through the bearing cap 35 forwardly of the recesses 66 and 67 and which serves the surfaces 33 and 34 of the camshaft 24 and 25, respectively.

Thus, from the foregoing description, it should be readily apparent to those skilled in the art the described constructions provide both a compact valve control arrangement for operating a VVT mechanism and also provide lubrication for substantially the entire axial surface at the forward end of the respective camshaft. Of course, the foregoing description is of a preferred embodiment of the invention. Various changes and modifications may be made without departing from the spirit and scope of the invention, as defined by the appended claims.

I claim:

1. An internal combustion engine having a cylinder head assembly journalling at least one camshaft for operating valves of said engine in a bearing member that is detachably connected to a cylinder head member said engine for journalling said camshaft, a camshaft drive arrangement at one end of said camshaft adjacent an end bearing surface thereof journalled in said bearing member, said camshaft drive arrangement incorporating a variable valve timing mechanism for varying the phase angle between a crankshaft driven element of said variable valve timing mechanism and said camshaft, said variable valve timing mechanism being hydraulically operated and supplied with lubricant for its actuation through supply grooves formed in said end bearing surface of said camshaft and adjacent said variable valve timing mechanism and drilled control passageways formed in said one end of said camshaft, a single lubricant supply passage formed in said cylinder head member communicating with a single lubricant inlet passage formed in said bearing member for supplying lubricant through passages formed in said bearing member: (1) to said camshaft end bearing surface in the area between said supply grooves for said variable valve timing mechanism and said variable valve timing mechanism, (2) to a control valve mounted in said bearing member that controls the supply of lubricant to said supply grooves, and (3) to said camshaft end bearing surface on the side opposite said supply grooves from the area between said supply grooves for said variable valve timing mechanism and said variable valve timing mechanism.

2. An internal combustion engine as set forth in claim 1 wherein a second cam shaft is also journalled in the bearing member.

3. An internal combustion engine as set fort in claim 2 wherein the second cam shaft has a hydraulically operated variable valve timing mechanism, lubricating mechanism and lubricating system that is the same as that of the first recited camshaft supplied with lubricant from a second lubricant supply passage formed in the cylinder head member that communicates with a second lubricant inlet passage formed in the bearing member.

* * * * *

UNITED STATES PATENT AND TRADEMARK OFFICE

CERTIFICATE OF CORRECTION

PATENT NO. : 6,032,629
DATED : March 7, 2000
INVENTOR(S) : Masahiro Uchida

It is certified that error appears in the above-identified patent and that said Letters Patent is hereby corrected as shown below:

In Claim 1, column 6, line 15, "engine in a" should be --engine formed in a--.

In Claim 1, column 6, line 16, "member said" should be --member of said--.

Signed and Sealed this

Tenth Day of April, 2001

*Attest:*

Nicholas P. Godici

NICHOLAS P. GODICI

*Attesting Officer*

*Acting Director of the United States Patent and Trademark Office*